US005724705A

United States Patent [19]

Hauser

[11] Patent Number: 5,724,705

[45] Date of Patent: Mar. 10, 1998

[54] DOOR SECURITY APPARATUS

[76] Inventor: David H. Hauser, 3544 Franklin Rd., Bloomfield Hills, Mich. 48302

[21] Appl. No.: 644,033

[22] Filed: May 9, 1996

[51] Int. Cl.[6] ..... E05D 5/02

[52] U.S. Cl. ..... 16/388; 16/387

[58] Field of Search ..... 16/388, 389, 82, 16/380, 382

[56] References Cited

U.S. PATENT DOCUMENTS

| | | | |
|---|---|---|---|
| 1,105,666 | 8/1914 | Johnson | 16/389 |
| 1,923,721 | 8/1933 | Glenn . | |
| 4,057,873 | 11/1977 | Bursani . | |
| 4,063,330 | 12/1977 | Triplette | 16/388 |
| 4,085,650 | 4/1978 | Flynn | 16/388 |
| 4,131,969 | 1/1979 | Suska . | |
| 4,133,114 | 1/1979 | Roach | 16/388 |
| 4,135,273 | 1/1979 | Holmes . | |
| 4,435,921 | 3/1984 | Mannel . | |

FOREIGN PATENT DOCUMENTS

| | | | |
|---|---|---|---|
| 2469538 | 5/1981 | France | 16/388 |
| 2504586 | 10/1982 | France | 16/388 |
| 1099900 | 2/1961 | Germany | 16/388 |

*Primary Examiner*—Chuck Mah
*Attorney, Agent, or Firm*—Howard & Howard

[57] ABSTRACT

A door security device for use in securing a door against unauthorized entry. The device includes a protrusion which can be mounted to the hinge side of a door or to the hinge side of a door frame and can be received within a recess in the opposite door or door frame. The protrusion in received by the recess to prevent the door from being removed by removal of a hinge pin.

5 Claims, 2 Drawing Sheets

DOOR SECURITY APPARATUS

BACKGROUND OF THE INVENTION

The present invention relates to a door security apparatus and, in particular, an apparatus to prevent the unauthorized opening of a door by removing the hinge pins.

A typical door assembly includes a door, a latch mechanism and hinges for mounting the door to an opening such as a door jamb. The latch mechanism typically includes some type of a locking mechanism so that the door can be locked for security purposes.

One difficulty with this type of door is the ability to remove the hinge pins and then the door to gain access. Typically, each hinge includes two hinge plates. One hinge plate has a series of knuckles and is attached to the door and a second hinge plate with a second series of intermeshing knuckles is attached to the door jamb. The knuckles are intermeshed and the hinge pin is inserted to secure the two hinge plates together. This allows one hinge plate to swing with respect to the other. As should be appreciated, with the door in the closed position and the locking mechanism engaged, the door cannot swing about the hinge. However, by removing the hinge pins, the door can be pulled outwardly a sufficient amount to release the intermeshed knuckles and allow the door to be removed from the doorway, allowing access.

This problem in door security has been recognized. U.S. Pat. No. 1,923,721 issued to Glenn on Aug. 22, 1933 discloses a hinge wherein the plates are provided with interlocking members to prevent the door panel from being removed from its frame after the hinge pin has been removed from the hinge. The hinge has integrally formed lugs 15 and 17 which mate to prevent the hinge from being separated by removal of the hinge pin. This can be seen in FIG. 3 of the Glenn patent. The problem with Glenn is that is requires the existing hinge plates to be removed and the Glenn hinge to be installed.

U.S. Pat. No. 4,057,873 issued to Bursani discloses a hinge plate having a projection 28 which penetrates and presses against a cooperating slot 29 in an opposite plate of a door hinge to prevent a locked door from being removed from a door jamb by removing the hinge pintles. Again, the disadvantage of Bursani is that it requires the existing door hinge to be removed and replaced with the Bursani hinge plate.

U.S. Pat. No. 4,131,969 issued to Suska discloses a security hinge which is very similar to the security hinges disclosed in Glenn and Bursani. In Suska, the security stud 11 has a hard surface and a roller to resist cutting. Suska also suffers from the same disadvantages as the prior references.

U.S. Pat. No. 4,135,273 issued to Holmes also teaches a security system similar too those of the previous references and suffers from the same disadvantages of the previous references.

All of the above attempts to solve the security problem involve modification of the standard hinge used to interconnect the door to the doorway. One disadvantage of these units is the inability to easily and inexpensively retrofit an existing doorway to provide the added security of a hinge side lock. In order to utilize the above systems, the existing door and hinges must be removed and the modified hinge installed. In many instances, the building owner does not want to go to the expense and trouble of removing the entryway doors in order to install this additional security device.

SUMMARY OF THE INVENTION

The present invention overcomes the above disadvantages of known hinge side security systems. In a first embodiment of the present invention, there is a hinge side security mechanism which can be easily installed on the hinge side of the door to provide the desired security. It involves a threaded pin member which can be attached to either the door or the doorway by a self-threading screw member. In the preferred embodiment, there is a self-threading screw with a flange having flats for receipt of a crescent wrench or pliers. Extending from the other side of the flange is a pin which is adapted to be received within a cavity formed opposite the pin. The cavity can either be a cavity which is drilled into the door or doorway, or a metal cavity. The metal cavity would include a self-threading screw with a flange similar to the screw and flange on the pin member. However, instead of having a pin, the flange and screw would define a cavity for receipt of the pin.

Installation is simple. First, the installer threads the threaded pin member into either the door or doorway. Once secured, the door is partially closed allowing the pin to mark the opposite member for either drilling the cavity with a drill or for receipt of the metal cavity. Once the cavity is installed, the security device is in place. When the door is closed, the pin mates with the cavity. Thereafter, if the hinge pins are removed, the pin mated within the cavity will prevent the door from being slid with respect to the door jam. A single door side security device as described could be used or a plurality could be installed depending upon the desired security level.

In a further embodiment of the present invention, a small L-shaped plate is secured to the hinge plate attached to the door and is received within a slot formed in the doorway. The L-shaped bracket includes holes which can be aligned with the existing holes in the door hinge. Preferably, the plate is a small plate with only one or two screw holes. One or more of the existing screws in the door hinge are removed and the base of the L-shaped plate is aligned and attached with the existing screws to the hinge plate. The base is sized so that the outwardly protruding leg of the L-shaped member extends slightly beyond the hinge plate so that when it engages the doorway, it engages slightly beyond the opposite hinge plate. A slot is formed in the doorway for receipt of the protruding leg to prevent the door from being slid outwardly with respect to the doorway.

A still further embodiment of the present invention employs a modified hinge wherein at least one side of the hinge is turned upwardly and is received within a cavity formed on the opposite hinge member. In this embodiment, three of the four sides of the hinge could be turned upwardly in order to prevent the door from being slid in any direction with respect to the doorway.

DETAILED DESCRIPTION OF PREFERRED EMBODIMENTS

Figure 1:
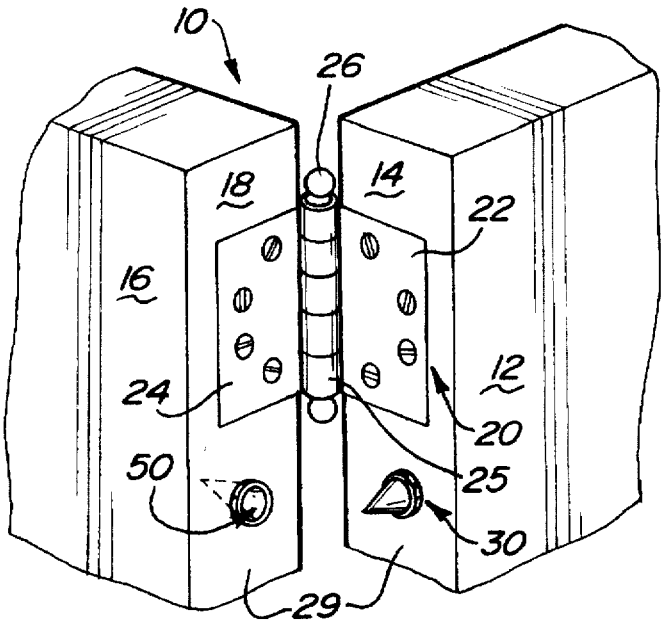
FIG. 1 is an exploded partial perspective view of a door jamb and doorway employing the first embodiment of the hinge side security apparatus of the present invention.

With reference to FIG. 1, a partial view of a door and doorway are generally shown at 10. The doorway 10 includes a door 12 having a hinge side 14 and a doorway 16 having a hinge side 18. Mounted between the opposed hinge sides is a hinge member 20 which includes a door side hinge bracket 22 and a doorway side hinge bracket 24. Each of these brackets or plates have intermeshing knuckles 25 which intermesh to receive a hinge pin 26. As is typical, a standard door will have two of these hinges spaced along and mounted between the door side and doorway side of the door 10.

Figure 2:
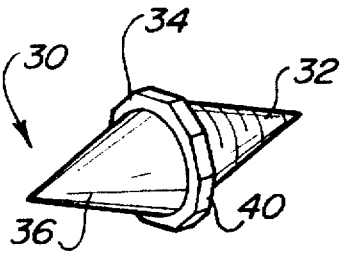
FIG. 2 is a perspective view of the locking pin of the hinge side security apparatus of the present invention.

The hinge side security apparatus is shown generally at 29. In this embodiment, see FIGS. 1 and 2, the locking pin 30 includes a threaded portion 32, a flange 34 and a locking pin 36. In the preferred embodiment, the threads are standard self taping wood threads so that they can be easily threaded into a wooden door. In the alternative, if a metal door is to be secured, the threads would be self-threading metal threads. The flange 34 has flats 40 so that a tool can grip the flange and facilitate threading the threaded portion 32 into the door side or doorway side of the door 10.

Figure 3:
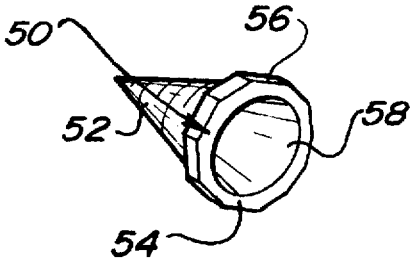
FIG. 3 is a perspective view of the cavity of the hinge side security apparatus of the present invention.

As illustrated, see FIG. 1 and 3, cavity 50 is a metal cavity which includes a threaded portion 52 and flange 54 with flats 56 to facilitate threading the threaded portion into the door side or doorway side of the door 10. The flange and threaded portion define a cavity 58 which is adapted to receive pin 36 when the door 12 is in its closed position.

In the preferred embodiment, both the pin 30 and cavity 50 are made of brass with a thread length of approximately 1½ inches and a cavity having a diameter of approximately ¼ inch. The flats are sized so that a ½ inch open end wrench or socket can be used to thread the threaded member 32. As should be appreciated, depending upon the security requirements, other sizes could be employed. Still further, the metal cavity is optional and a cavity adapted to receive the pin could be formed by merely drilling a cavity into either the door side or doorway side of the door.

The system is readily adapted for use in retrofitting an existing door. To install the security apparatus, a position is selected along, for example, the door side 12 of the doorway. For ease of installation, a punch can be used to form an indentation in the hinge side 14 of the door 12 to facilitate threading of the pin member 30. The pin member 30 is then positioned and threaded into the door side. In the preferred embodiment, a pilot hole is not necessary, but could easily be used to facilitate mounting of the pin. Once the locking pin 30 is threaded completely into the door side, the door is partially closed to mark the opposite side. Then a metal cavity 50 is installed in the same manner as the locking pin 30 or a cavity is formed by drilling. After the cavity is formed, the door can be closed and the pin 36 of locking pin 30 will enter the cavity to prevent the door 12 from being slid outwardly with respect to the doorway 16.

Figure 4:
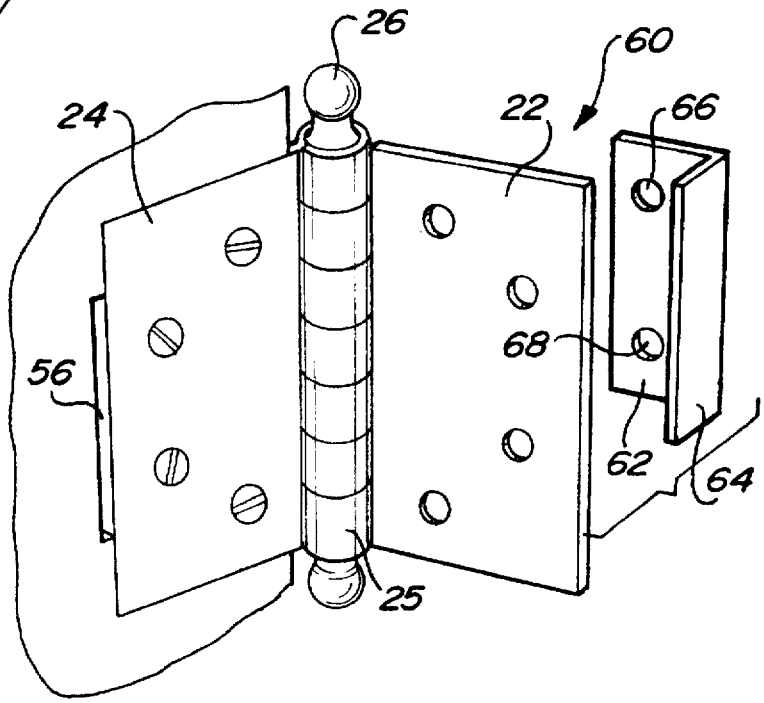
FIG. 4 is a perspective exploded view of a further embodiment of the hinge side security apparatus of the present invention.

With respect to FIG. 4, the second embodiment of the present invention is illustrated, generally, at 60. For purposes of clarity, the same numbers have been used to identify the same elements previously described in FIG. 1. In this embodiment, the hinge side security apparatus is an L-shaped member having a foot portion 62 and a leg portion 64. The foot portion is illustrated having two apertures 66 and 68 which are adapted to receive the existing hinge screws so that the leg portion can be attached to the existing hinge plate. The foot portion 62 has a length to allow the foot portion 62 to extend slightly beyond the existing hinge plate. The foot and leg are approximately ⅛ inch wide with the foot portion being approximately ¼ inch in length and extending approximately ⅛ of an inch beyond the hinge plate. The leg is approximately ⅛ to ¼" in length. A slot 56 is formed in the opposite wall for receipt of the foot portion 64. The slot can be formed by a router, or chisel. Because the slot 66 is formed immediately adjacent the hinge plate 24, the foot 64 will engage the slot and be restricted by the hinge plate 24 for added security.

To install, the two existing hinge screws are removed and the hinge leg is attached to the existing hinge plate. The door is slightly closed to mark the location of the slot adjacent the hinge plate. In order to facilitate marking, the edge of the foot can be formed with an edge. Once the slot is marked, it can be formed to slightly greater than ⅛ to ¼ of an inch in depth for receipt of the foot portion 64. Because of the assistance of the existing hinge plate in preventing the foot portion from being pulled from the slot, the foot portion 64 can be narrow and the slot 66 itself can be narrow as well.

Figure 5:
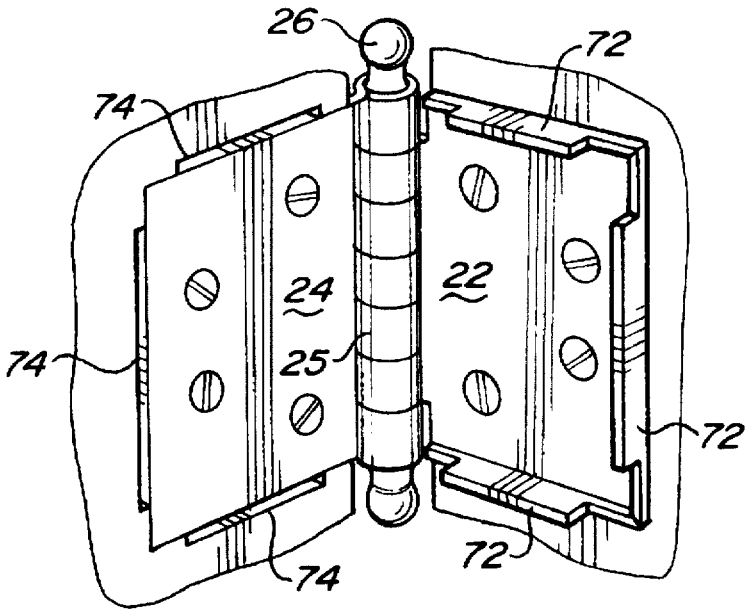
FIG. 5 is a perspective view of a still further embodiment of the present invention.
Figure 6:
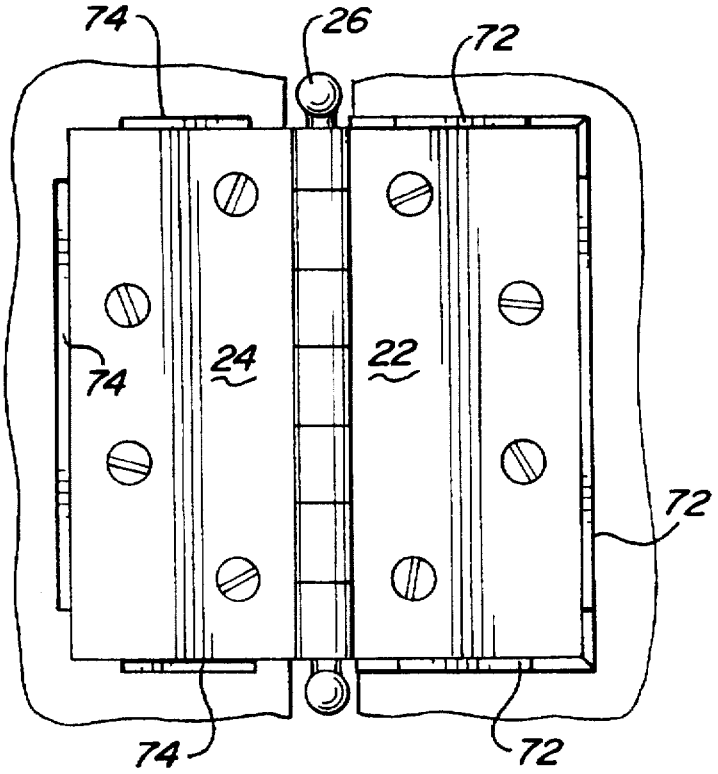
FIG. 6 is a plan view of FIG. 5.
Figure 7:
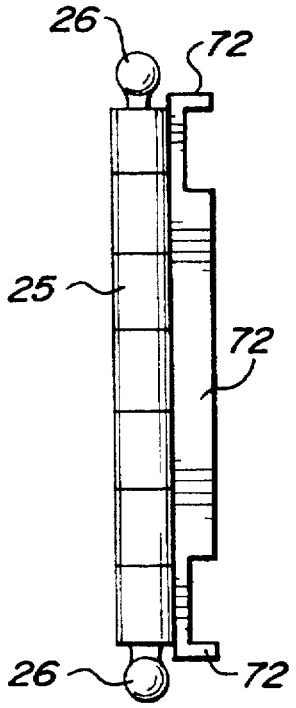
FIG. 7 is an end view of FIG. 5 in the closed position.

With reference to FIGS. 5, 6 and 7, a still further embodiment of the present invention will be described. With reference to FIG. 5, an improved hinge is shown generally at 70. This hinge includes hinge plates 22 and 24 which are connected by a hinge pin 26. One of the hinge pins has protrusions 72 which are preferably formed by bending the hinge plate 22 and formed during the stamping of the hinge plate, but could be added to the hinge plate by welding or other attachment means. These protrusions 72 are illustrated as tabs which extend generally perpendicular to the hinge plate 22 and are adapted to be received within slots 74 positioned adjacent the opposite hinge plate 24. These slots would be formed either in the door frame or door depending upon how the hinge 70 is mounted. Additionally, instead of slots, the hinge plate 24 could be made thicker so that the tab 72 would engage or be positioned adjacent the edges of the plate 24. This would be a particular advantage in gates or other assemblies in which it is difficult form slots 24.

In this embodiment, the hinge 70 would replace an existing hinge. The benefit of hinge 70 is that it provides security for doors that are not mounted within a typical door frame. With the tabs 72 protruding outwardly on the top, bottom and side edges of plate 22, the door cannot be removed by sliding it outwardly or by removal in either an upward or downward direction.

The form of the invention described is illustrative and may be embodied in other forms while still employing the inventive principles contained herein. The invention has been described as applicable to a door and corresponding door jam, but it is equally applicable to hinges for windows, boxes and other closures. All such modifications and variations are intended to be within the scope of the invention as defined in the following claims.

I claim:

1. A door security device for use in securing a door against unauthorized entry, the door having a hinge edge having hinges for interconnecting the door to a doorway hinge side, the security device comprising:

a pin having an elongated body with an exposed portion and a threaded portion, said threaded portion being adapted to be threaded into the hinge edge or hinge side;

a cavity adapted to be formed in the other of the hinge edge or hinge side for receipt of the exposed portions, the cavity is defined by an elongated body having a partially threaded exterior and an interior which is open to receipt of the exposed portion;

the exposed portion being adapted to be received within the cavity once the door is closed to prevent opening of the door by removal of the hinge pins.

2. The door security device of claim 1, wherein the pin member elongated body includes a flange separating the exposed portion and the threaded portion, the flange facilitates attachment of the pin member to the hinge side of the door.

3. The door security device of claim 2, wherein the flange includes flats for receipt of a tool to facilitate threading of the pin member into the hinge side of the door.

4. The door security device of claim 1, wherein the exposed portion has a pointed free end.

5. The door security device of claim 1, wherein the cavity includes a flange which has flats for receipt of a tool to facilitate threading the cavity end into the hinge side of the door.

* * * * *